US010126686B2

(12) United States Patent
Fukazawa et al.

(10) Patent No.: US 10,126,686 B2
(45) Date of Patent: Nov. 13, 2018

(54) IMAGE FORMING APPARATUS INCLUDING CLEANING UNIT WITH BRUSH ROLLER, ROTATABLE MEMBER, AND BLADE MEMBER

(71) Applicant: CANON KABUSHIKI KAISHA, Tokyo (JP)

(72) Inventors: Toshiya Fukazawa, Tokyo (JP); Yutaka Koga, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/200,123

(22) Filed: Jul. 1, 2016

(65) Prior Publication Data

US 2017/0003628 A1 Jan. 5, 2017

(30) Foreign Application Priority Data

Jul. 2, 2015 (JP) ..... 2015-133806

(51) Int. Cl.
*G03G 15/16* (2006.01)

(52) U.S. Cl.
CPC ..... *G03G 15/161* (2013.01); *G03G 15/168* (2013.01)

(58) Field of Classification Search
CPC ..... G03G 2215/1647; G03G 15/161; G03G 15/168
USPC ..... 399/101
See application file for complete search history.

(56) References Cited

U.S. PATENT DOCUMENTS

| | | | | |
|---|---|---|---|---|
| 6,219,522 | B1 * | 4/2001 | Ishizuka | G03G 15/2053 399/333 |
| 9,128,457 | B2 | 9/2015 | Koga | |
| 2006/0045583 | A1 * | 3/2006 | Jones | G03G 15/2025 399/327 |
| 2013/0223872 | A1 * | 8/2013 | Aiba | G03G 15/161 399/101 |
| 2015/0063861 | A1 * | 3/2015 | Meguro | G03G 15/161 399/101 |

FOREIGN PATENT DOCUMENTS

| | | | |
|---|---|---|---|
| JP | H07-121038 | A | 5/1995 |
| JP | 2007-132999 | A | 5/2007 |
| JP | 2013-003543 | A | 1/2013 |
| JP | 2013-195559 | A | 9/2013 |

* cited by examiner

*Primary Examiner* — Walter L Lindsay, Jr.
*Assistant Examiner* — Ruth Labombard
(74) *Attorney, Agent, or Firm* — Fitzpatrick, Cella, Harper & Scinto

(57) ABSTRACT

An image forming apparatus includes a cleaning unit for a transfer roller. A cleaning unit includes a brush roller, a rotatable member, a first blade and a second blade. The brush roller is electroconductive and contactable with the transfer roller while rotating to electrostatically attract the toner from the transfer roller. The rotatable member is supplied with a voltage of the regular charge polarity of the toner and is contacted with the brush roller in a contact position to electrostatically attract the toner from the brush roller. The first blade contacts the rotatable member in a cleaning portion to scrape a deposited matter from the rotatable member. The second blade is disposed downstream of the cleaning portion and upstream of the contact portion and scrape the deposited matter from the rotatable member with the rotation of the rotatable member.

10 Claims, 10 Drawing Sheets

IMAGE FORMING APPARATUS INCLUDING CLEANING UNIT WITH BRUSH ROLLER, ROTATABLE MEMBER, AND BLADE MEMBER

FIELD OF THE INVENTION AND RELATED ART

The present invention relates to an image forming apparatus which forms a toner image on recording medium with the use of an electrophotographic method or the like.

There have been known image forming apparatuses equipped with a cleaning means having: a brushing member which contacts a photosensitive member which is in the form of a drum; and an elastic blade which contacts the photosensitive member, on the downstream side of the brushing member, as disclosed in Japanese Laid-open Patent Application NO. 2007-132999. In the case of these image forming apparatuses, toner having adhered to the photosensitive member is electrostatically adhered to the brushing member, is recovered by a recovery roller which is in contact with the brushing member, and then, scraped away from the recovery roller by a scraping member which is in contact with the recovery roller. Further, film forming substances such as wax, which pass by the brushing member and become stuck to the peripheral surface of the photosensitive member, are scraped down by an elastic plate which contains abrasives.

By the way, there are image forming apparatuses having: an image bearing member which bears and conveys a toner image; and a transfer-conveyance belt which forms between itself and the photosensitive member, a transferring portion which transfers a toner image onto a sheet of recording medium, and which is structured so that it can form a toner image on both surfaces of a sheet of recording medium. In a case where one of these image forming apparatuses is made to form images on both surfaces of a sheet of recording medium, after a toner image is transferred onto one of the two surfaces of the sheet S, the sheet and the toner image thereon are heated by a heating means such as a fixation roller, and therefore, the wax contained in the toner is heated (warmed). Thus, as the sheet S is conveyed to the transferring portion for the second time, the first surface of the sheet, or the surface onto which a toner image was transferred while the sheet S is conveyed through the transferring portion for the first time, comes into contact with the transfer-conveyance belt, making it possible for the heated (warmed) wax to adhere to the transfer-conveyance belt.

It is possible to provide these image forming apparatuses with a brush roller to which the toner having adhered to the surface of the transfer-conveyance belt adheres, a recovery roller which recovers the toner adhered to the brush roller; and a recovery roller scraping member which scrapes away the toner having adhered to the recovery roller. In this case, film forming substances, such as wax, having adhered to the transfer-conveyance belt adheres to the recovery roller by way of the brush roller. However, the film forming substances are greater in adherence to the recovery roller than toner. Therefore, it is rather difficult to fully remove the film forming substances from the recovery roller by the recovery roller scraping member. Further, as film forming substances such as the above described ones accumulate on the recovery roller and transfer-conveyance belt, they cause such a problem that a sheet of recording medium is soiled across its surface facing the transfer-conveyance belt.

Further, it is possible to equip these image forming apparatuses with a scraping member, such as an elastic blade disclosed in Japanese Laid-open Patent Application No. 2007-132999, which contacts the transfer-conveyance belt to scrape away the film forming substances, in addition to the abovementioned brush roller. In this case, however, in order to prevent the transfer-conveyance belt from being damaged, it is necessary to control (minimize) the contact pressure between the scraping member and transfer-conveyance member. Thus, it is difficult to remove all the film forming substances.

SUMMARY OF THE INVENTION

According to an aspect of the present invention, there is provided an image forming apparatus comprising a movable intermediary transfer member; a toner image forming unit configured to form a toner image on said intermediary transfer member, wherein toner of the toner image comprises wax; a transfer rotatable member contactable to said intermediary transfer member to form a transfer portion in which a transferring electric field for transferring the toner image from said intermediary transfer member onto a recording material fed into the transfer portion is formed; a fixing unit configured to fix the toner image on the recording material by heating the recording material together with the toner image carried thereon; a feeding portion configured to feed the recording material after passing through said fixing unit, said feeding portion feeding the recording material such that a surface of the recording material carrying the toner image facing toward said transfer rotatable member by the transfer portion; an executing portion configured to execute double-sided image forming operation for forming toner images on respective sides of the recording material while passing the recording material through said feeding portion; and a cleaning unit configure to electrostatically remove the toner from said transfer rotatable member; wherein said cleaning unit includes a brush roller, a rotatable member, a first blade member and a second blade member, and said brush roller is electroconductive and contactable with said transfer rotatable member while rotating to electrostatically attract the toner from said transfer rotatable member, wherein said rotatable member is supplied with a voltage of the same polarity as a regular charge polarity of the toner and is contacted with said brush roller in a contact position to electrostatically attract the toner from said brush roller, wherein said first blade member contacts said rotatable member in a cleaning portion to scrape a deposited matter from said rotatable member with rotation of said rotatable member, and wherein said second blade member is disposed downstream of the cleaning portion and upstream of the contact portion with respect to a rotational moving direction of said rotatable member and scrape the deposited matter from said rotatable member with the rotation of said rotatable member.

Further features of the present invention will become apparent from the following description of exemplary embodiments with reference to the attached drawings.

DESCRIPTION OF THE EMBODIMENTS

Hereinafter, the image forming apparatus in one of the preferred embodiments of the present invention is described with reference to the appended drawings. By the way, the image forming apparatus in the following embodiment is a color printer. However, the present invention is also applicable just as well to other image forming apparatuses than a color printer. For example, it is applicable to a monochromatic printing machine, a facsimileing machine, a multifunction machine, etc. By the way, regarding the orientation of the image forming apparatus in the following description of the image forming apparatus, it is assumed that the apparatus is seen from its front side (in FIG. 1).

[Image Forming Apparatus]

Figure 1:
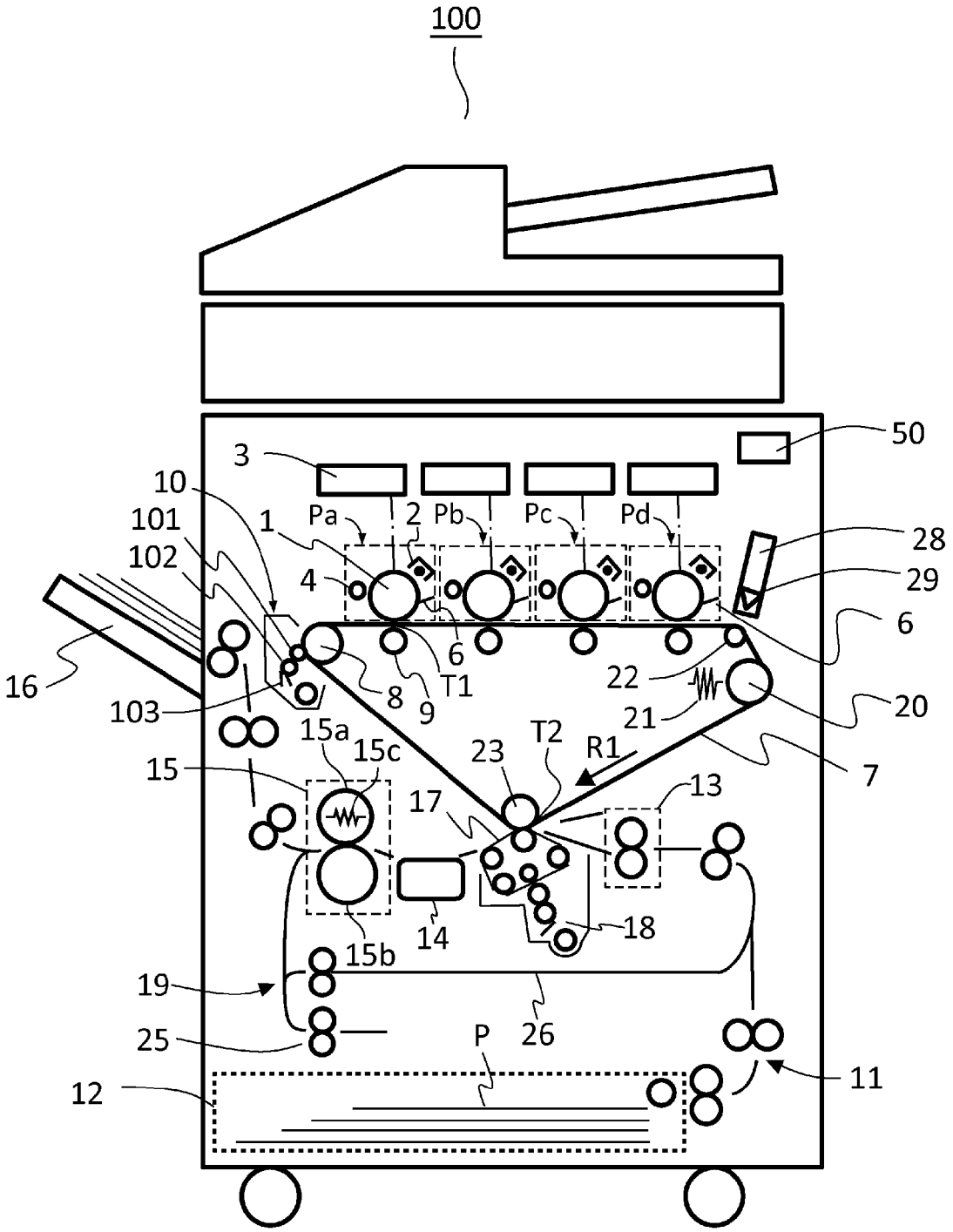
FIG. 1 is a schematic sectional view of a typical image forming apparatus to which the present invention is applicable, which shows the general structure of the apparatus.

Referring to FIG. 1, the image forming apparatus 100 in the first embodiment of the present invention has image forming portions Pa, Pb, Pc and Pk, as image forming means, which form four monochromatic toner images, more specifically, yellow (Pa), magenta (Pb), cyan (Pc) and black (Pd) toner images, respectively. The image forming apparatus 100 is a full-color printer of the so-called tandem type, and also, of the so-called intermediary transfer type. That is, these image forming portions Pa, Pb, Pc and Pd are disposed in tandem along an intermediary transfer belt 7. Further, the image forming apparatus 100 has a feeding-conveyance unit 12, a conveyance unit 11, a registration unit 13, a secondary transfer unit 17, a fixation unit 15, a reversal conveyance unit 19, etc., in addition to the four image forming portions and intermediary transfer belt 7.

Sheets P of recording medium (for example, recording paper, OHP film, etc.) are stored in layers in the tray of the feeding-conveyance unit 12. They are held by a lifter plate of the tray so that the topmost sheet is kept at a preset position (height) from which it is to be fed into the main assembly of the image forming apparatus 100, while being separated one by one from the rest in the tray, with the use of an air-based conveyance method, by the conveyance unit 11. Each sheet P of recording medium is conveyed through the interior of the main assembly of the image forming apparatus 100. First, it is conveyed to the registration unit 13 by which it is corrected in attitude, and adjusted in conveyance timing. Then, it is conveyed to the secondary transferring portion T2 in synchronism with the toner images which have just been formed through an image formation process, which will be described later, and transferred (primary transfer) onto the intermediary transfer belt 7.

The secondary transferring portion T2 (transferring portion) is the nip between the portion of the intermediary transfer belt 7, which is in contact with the secondary transfer inward roller 23, which is one of the rollers by which the intermediary transfer belt 7 is suspended, and the portion of the secondary transfer belt 176 of the secondary transfer unit 17, which will be described later. Then, the sheet P is conveyed by the intermediary transfer belt 7 through the secondary transferring portion T2 while remaining pinched between the intermediary transfer belt 7 and secondary transfer belt 176. While the sheet P is conveyed through the secondary transferring portion T2, the toner images borne on the intermediary transfer belt 7 are transferred onto the sheet P by the bias voltage applied to the secondary transfer inward roller 23.

After the transfer of the toner images onto the sheet P, the sheet P is conveyed to the fixation unit 15 by a pre-fixation conveyance unit 14. The fixation conveyance unit 15 has a combination of a fixation roller 15*a* and a pressure roller 15*b*, which is capable of applying pressure to the sheet P while conveying the sheet P by pinching the sheet P between the rollers 15*a* and 15*b*. It has also a heat generating electric wire 15*c*, as a heating means, for heating the toner images transferred onto the sheet P. As the sheet P is heated and pressed while remaining pinched by the fixation roller 15*a* and pressure roller 15*b*, the toner images on the sheet P are thermally fixed to the sheet P (fixed image is obtained).

When the image forming apparatus 100 is in the two-sided print mode, the sheet P of recording medium is sent to the reversal conveyance unit 19 (reversal conveyance unit) after it is moved through the fixation unit 15 the first time. The reversal conveyance unit 19 has: a switchback roller 25 which turns the sheet P over by making the sheet P switchback; and a reversal conveyance passage 26 through which the overturned sheet P is conveyable to the secondary transferring portion T2. After being conveyed through the reversal conveyance passage 26, the sheet P of recording medium is adjusted in registration by the registration unit 13. Then, it is made to enter the secondary transferring portion T2, for the second time, with its back surface facing the intermediary transfer belt 7. After toner images are transferred onto the back surface of the sheet P in the secondary transferring portion T2, the sheet P is conveyed to the fixation unit 15 through the pre-fixation conveyance unit 14 so that the toner image on the back surface of the sheet P can be fixed. When the image forming apparatus 100 is in the one-sided print mode, it is after the sheet P is moved through the fixation unit 15 for the first time that the sheet P is conveyed by the discharge unit, and is discharged into the delivery tray 16 which is exposed from the apparatus main assembly.

[Image Forming Portions]

Next, referring to FIG. 1, the structure of the image forming portion, and toner image formation process, are described with reference to the image forming station Pa which forms a yellow image, are described. The other image forming portions Pb, Pc and Pd are the same in structure as the image forming portion Pa, although they are different in the color of the toner they use. Therefore, they are not described. The image forming station Pa has: a photosensitive drum 1 which rotates in the same direction as that in which the intermediary transfer belt 7 is conveyed (indicated by arrow mark R1) in the primary transferring portion T1; and processing means, more specifically, a charging device 2, an exposing device 3, a developing device 4, a primary transfer roller 9, a drum cleaning device 6; etc.

The photosensitive drum 1 is a photosensitive member. It comprises an aluminum cylinder, and a negatively chargeable photosensitive layer formed on the peripheral surface of the aluminum cylinder. It is rotationally driven at a preset process speed which matches the speed at which the intermediary transfer belt 7 is conveyed. The charging device 2 is of the so-called corona discharge type. It uniformly charges the peripheral surface of the photosensitive drum 1 to a preset negative potential level VD (pre-exposure level). The exposing device 3 has: a light emitting portion which emits a beam of laser light while modulating the beam with image formation signals; and a rotational mirror which reflects the beam of laser light emitted from the light emitting portion, in such a manner that the beam scans the peripheral surface of the photosensitive drum 1. It writes an electrostatic image by removing electric charge from specific points of the peripheral surface of the photosensitive drum 1.

The developing device 4 has a development sleeve which rotates while bearing toner on its peripheral surface. It develops the electrostatic latent image on the photosensitive drum 1 into a visible image, that is, an image formed of toner, by supplying the photosensitive drum 1 with toner. The primary transfer roller 9 is disposed so that it is pressed against the photosensitive drum 1 with the presence of the intermediary transfer belt 7 between itself and photosensitive drum 1. It forms the primary transferring portion T1 between the photosensitive drum 1 and intermediary transfer belt 7. It is in connection to an unshown high voltage output circuit. To the primary transfer roller 9, positive DC voltage (primary transfer bias voltage) is applied. The toner image borne on the photosensitive drum 1 is transferred onto the intermediary transfer belt 7 (primary transfer) by the primary transfer bias voltage. The residual toner particles, etc., that is, the toner particles, etc., which failed to be transferred onto the intermediary transfer belt 7, and are remaining on the photosensitive drum 1 after the primary transfer, are recovered by the drum cleaning device 6. Toner image formation processes which are similar to the above described one are carried out in parallel in the other image forming portions Pm, Pc and Pd, respectively.

The intermediary transfer belt 7 as an intermediary transferring member is an endless belt. It is disposed so that it moves through the primary transferring portion T1 of each of the four image forming stations Pa, Pb, Pc and Pd which are horizontally aligned in tandem. The intermediary transfer belt 7 is suspended by the primary transfer roller 9, a driver roller 8, a tension roller 20, an idler roller 22, and the secondary transfer inward roller 23. It is conveyed in the preset conveyance direction (arrow mark R1) by the driver roller 8, which is driven by an unshown driving device. The four monochromatic images, different in color, formed in the image forming stations Pa, Pb, Pc and Pd, one for one, as described above, are transferred onto the intermediary transfer belt 7 in such a manner that the toner images other than the yellow toner image which is transferred first, are layered upon the yellow toner image. Thus, a full-color toner image is effected on the intermediary transfer belt 7. The intermediary transfer belt 7 is an example of an image bearing member which can be conveyed toward the secondary transferring portion T2 while bearing toner images.

The tension roller 20 is slidable in the direction to press the intermediary transfer belt 7 outward of the loop which the intermediary transfer belt 7 forms. The length end portions of the tension roller 20 are under the pressure from a pair of compression springs 21 which are disposed in contact with the lengthwise ends of the tension rollers 20, so that the intermediary transfer belt 7 is provided with a proper amount of tension. The secondary transfer inward roller 23 is disposed so that it opposes the secondary transfer unit 17, which will be described later. On the downstream side of the secondary transferring portion T2, the intermediary transfer belt cleaning device 10 is disposed, which recovers the toner and the like contaminants which moved through the secondary transferring portion T2 and are remaining on the surface of the intermediary transfer belt 7. This intermediary transfer belt cleaning device 10 is similar in structure to a cleaning device 18 which is for cleaning the secondary transfer belt 176 which will be described later. The intermediary transfer belt cleaning device 10 has a fur brush 101, a bias roller 102, and a scraping member 103 which includes a rubber blade and a scraper.

By the way, there is disposed an optical sensor unit 28 on the downstream side (left side in FIG. 1) of the image forming portion Pd, which is the most downstream one among the four image forming portions. The sensor unit 28 has a light receiving portion 29 which opposes the surface of the intermediary transfer belt 7. It determines the toner density of a control patch formed on the surface of the intermediary transfer belt 7, by measuring the amount of infrared light reflected by the control patch. The portion of the intermediary transfer belt 7, which opposes the light receiving portion 29, is supported by the idler roller 22.

Each of the image forming portions Pa, Pb, Pc and Pd forms a control patch on the intermediary transfer belt 7 based on control signals sent from a controlling device 50, with which the main assembly of the image forming apparatus 100 is provided, in parallel to the progression of the process for forming a toner image. More specifically, a control patch is formed on the portion of the intermediary transfer belt 7, which corresponds to the interval of the consecutive two toner images which are to be transferred onto a sheet P of recording medium, in the secondary transferring portion T2. In other words, a control patch is formed on the area of the intermediary transfer belt 7, which is between the area (first area) of the intermediary transfer belt 7, the across which a toner image which is to be transferred onto the first sheet P of recording medium is formed, and the area (second area) of the intermediary transfer belt 7, across which a toner image to be transferred onto the second sheet P of recording medium which is conveyed through the secondary transferring portion T2 immediately after the first sheet P, is formed. The sensor unit 28 measures in density, the control patch for each toner color, and transmits feedback signals to the controlling device 50. Based on these feedback signals, the controlling device 50 performs various operations. For example, it adjusts the exposing device 3 in the amount of beam of laser light, sets development bias, and adjusts the amount by which the developing device 4 is supplied with toner. The controlling device 50 transfers the control patch onto the secondary transfer belt 176, in the secondary transferring portion T2, as will be described later.

[Secondary Transfer Unit]

Figure 2:
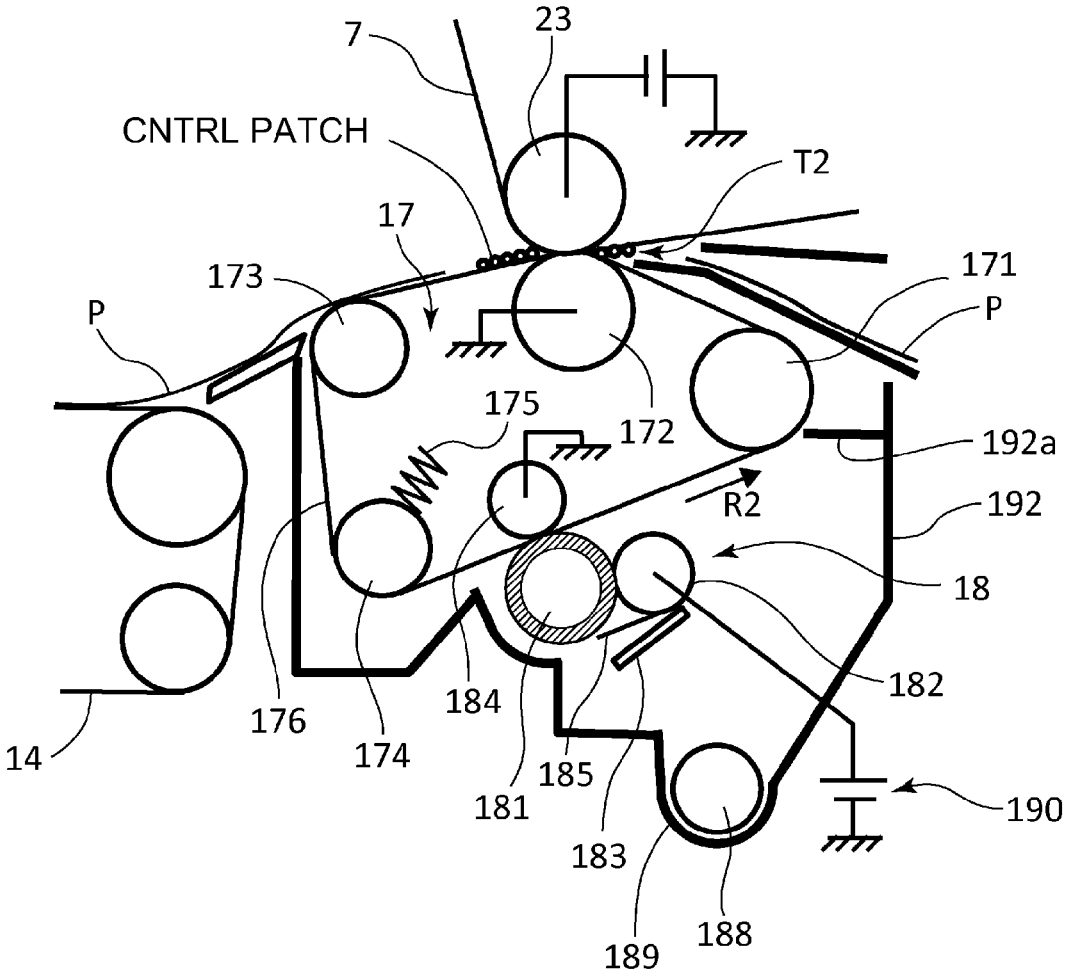
FIG. 2 is a sectional view of a combination of the secondary transfer belt and cleaning device of the image forming apparatus shown in FIG. 1.

Next, the secondary transfer unit 17 which forms the secondary transferring portion T2, in conjunction with the intermediary transfer belt 7 and secondary transfer inward roller 23, is described. Referring to FIG. 2, the secondary transfer unit 17 comprises: a driver roller 171, a secondary transfer outward roller 172, a separation roller 173, a tension roller 174, and a secondary transfer belt 176 which is suspended by the preceding rollers. The driver roller 171, secondary transfer outward roller 172, separation roller 173, and tension roller 174 are disposed in parallel to each other, and are rotatably supported by a case 192 (casing member), by their lengthwise ends in terms of the direction parallel to their axial line. The case 192 is removably mountable in the main assembly of the image forming apparatus 100. The secondary transfer unit 17 is disposed within the case 192, along with the cleaning device 18 which will be described later.

The secondary transfer outward roller 172 is disposed on the downward side of the second transfer inward roller 23. It keeps the intermediary transfer belt 7 and secondary transfer belt 176 pinched between itself and the second transfer inward roller 23, in the nip formed between itself and second transfer inward roller 23. The secondary transfer belt 176 is conveyed by the driver roller 171 which is in connection to an unshown motor, in such a direction (arrow mark R2) that it is moved in the same direction as the intermediary transfer belt 7, in the nip.

The secondary transfer outward roller 172 is grounded, whereas the second transfer inward roller 23 is connected to the high voltage output circuit, being supplied with the secondary transfer bias which is negative. The toner particles of which the toner images and control patches borne on the intermediary transfer belt 7 are formed, are negatively charged. Therefore, electrostatic bias which acts in the direction to move the toner particles from the intermediary transfer belt 7 to the secondary transfer belt 176 is provided in the secondary transferring portion T2. That is, not only does the secondary transferring portion T2 formed as a nip (transfer nip) between the intermediary transfer belt 7 and secondary transfer belt 176 convey a sheet P of recording medium by pinching the sheet P, but also, it transfers the toner images borne on the intermediary transfer belt 7 onto the sheet P. Further, it is between consecutive two sheets P of recording medium that each control patch is moved through the secondary transferring portion T2 (FIG. 2). Therefore, the toner particles in the control patch are transferred onto the secondary transfer belt 176, in the secondary transferring portion T2. By the way, these toner particles from the control patches are removed from the surface of the secondary transfer belt 176 by the cleaning device 18, as will be described later.

The secondary transfer belt 176 is conveyed in such direction that the top portion of the secondary transfer belt 176, in terms of the loop which it forms, which faces the path of a sheet P of recording medium in the secondary transferring portion T2, moves leftward, whereas the bottom portion of the secondary transfer belt 176, which faces the cleaning device 18, moves rightward. The conveyance speed of the secondary transfer belt 176 is controlled so that it becomes roughly the same as that of the intermediary transfer belt 7, in the secondary transferring portion T2. The tension roller 174 keeps the secondary transfer belt 176 stable in tension, by pressing the secondary transfer belt 176 by being pressed by the tension springs 175 which are elastic members. The separation roller 173 is disposed on the downstream side of the secondary transfer outward roller 172 in terms of the conveyance direction of the secondary transfer belt 176. The image forming apparatus 100 is structured so that a sheet P of recording medium can be separated from the secondary transfer belt 176 by the curvature of the separation roller 173. As the sheet P is separated from the secondary transfer belt 176, it is delivered to the pre-fixation conveyance unit 14.

By the way, as the toner image is transferred (secondary transfer) onto a sheet P of recording medium while the sheet P is remaining pinched by the secondary transferring portion T2, the sheet P is made opposite in polarity from the secondary transfer belt 176 by the electric charge of the toner image. Thus, the sheet P remains electrostatically adhered to the secondary transfer belt 176. Thus, it is assured that the sheet P is reliably conveyed by the secondary transfer belt 176.

[Cleaning Device]

Next, the cleaning device 18 which is a cleaning means for removing the toner particles and the like adherent contaminants having adhered to the secondary transfer belt 176 is described. These adherent contaminants include the toner particles from the control patch, etc., and film forming substances, etc., which will be described later. As an example of the adherent contaminant other than the toner particles from the control patch, there are the toner particles in the toner image on the intermediary transfer belt 7, which failed to be transferred onto a sheet P of recording medium due to the occurrence of paper jam, for example, and therefore, were transferred onto the secondary transfer belt 176, in the secondary transferring portion T2.

Referring to FIG. 2, the cleaning device 18 is a cleaning device of the fur brush type. It has a fur brush 181, and electrostatically cleans the surface of the secondary transfer belt 176 with its fur brush 181. The cleaning device 18 has the fur brush 181, a belt-backing roller 184, a bias roller 182, a cleaning blade 183, a scraper 185, and a conveyance screw 188. It is covered with the case 192, along with the secondary transfer unit 17. The case 192 is shaped long and narrow, and is provided with an opening. It is disposed in the main assembly of the image forming apparatus 100 so that its lengthwise direction becomes parallel to the widthwise direction of the intermediary transfer belt 7 (front-rear direction of apparatus main assembly), and the opening faces upward. Further, it is disposed on the underside of the recording medium conveyance passage.

Figure 3:
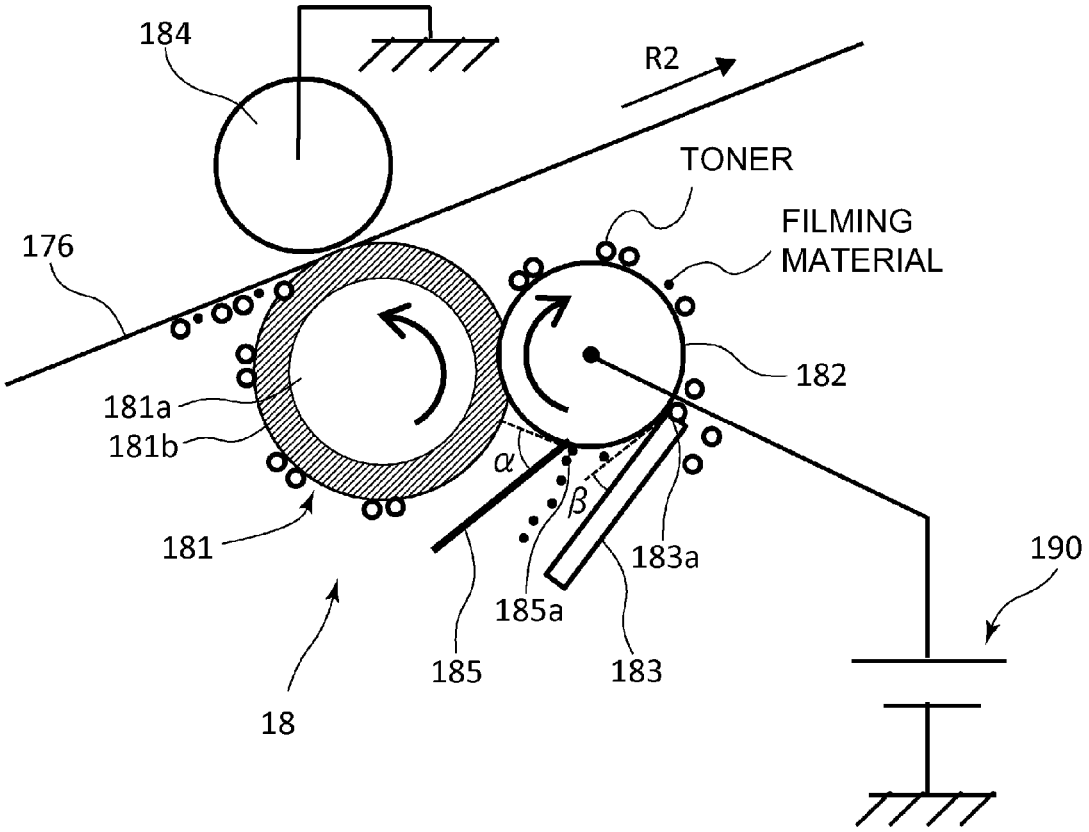
FIG. 3 is a schematic drawing of the essential portion of the cleaning device.

The fur brush 181 (brush roller) causes the toner particles having adhered to the surface of the secondary transfer belt 176, to electrostatically adhere to the fur brush 181. Referring to FIG. 3, the fur brush 181 is disposed in contact with the outward surface of the secondary transfer belt 176. It keeps the secondary transfer belt 176 between itself and the belt-backing roller 184 which is positioned to pinch the secondary transfer belt 176 between itself and the fur brush 181. The bias roller 182 is an example of recovery roller which recovers the toner particles adhered to the fur brush 181. It is disposed on the right side of the fur brush 181, and is in contact with the fur brush 181. The fur brush 181 is made up of a core 181*a* (metallic core), and electrically conductive fibers 181*b* planted on the peripheral surface of the core 181*a*. It is disposed so that it fictitiously intrudes into the secondary transfer belt 176 and bias roller 182 by preset depths, one for one. By the way, "depth of intrusion" means the difference between the maximum radius of the fur brush 181, that is, the radius of the fur brush 181 when the fur brush 181 is not in contact with either of the secondary transfer belt 176 and bias roller 182, and the distance from the axial line of the fur brush 181 to the area of contact between the fur brush 181 and bias roller 182, or to the area of contact between the fur brush 181 and secondary transfer belt 176.

The fur brush 181 and bias roller 182 are in connection to the bias application electric power source 190 of the high voltage output circuit, with which the main assembly of the image forming apparatus 100 is provided, whereby they are provided with bias voltage (positive) which is opposite in polarity from the electric charge of the toner. The value for this bias voltage is set so that the bias roller 182 becomes higher in potential level than the fur brush 181. By the way, the belt-backing roller 184 is grounded, being therefore the same in potential level as the ground.

The bias roller 182 is a cylindrical metallic roller. It is disposed in such an attitude that its axial line is parallel to the fur brush 181, and extends in the direction parallel to the widthwise direction of the secondary transfer belt 176. By the way, a "metallic roller" includes a roller which is formed of a metallic substance, and the peripheral surface of which is coated with resin or the like substance. The fur brush 181, bias roller 182, and belt-backing roller 184 are rotatably supported by the case 192 at their lengthwise ends. The fur brush 181 is rotationally driven by an unshown driving device in such direction that it moves in the opposite direction from the conveyance direction (arrow mark R2) of the secondary transfer belt 176, in the area of contact between itself and secondary transfer belt 176. The bias roller 182 is rotationally driven in such direction that it moves in the same direction as the fur brush 181, in the area of contact between itself and fur brush 181.

The cleaning device 18 is provided with the cleaning blade 183 (first scraping member) and scraper 185 (second scraping member), each of which is a member for scraping away the contaminants having adhered to the bias roller 182. Each of the cleaning blade 183 and scraper 185 is such a member that is in the form of a blade (flat member). The cleaning blade 183 and scraper 185 are disposed so that their cleaning edges 183*a* and 185*a*, respectively, contact the bias roller 182. Further, they are angled so that their cleaning edges 183*a* and 185*a* are on the upstream side of their base portions, in terms of the rotational direction of the bias roller 182. In terms of the rotational direction of the bias roller 182, the scraper 185 is in contact with the bias roller 182 on the downstream side of the cleaning blade 183, and on the upstream side of the area of contact between the fur brush 181 and cleaning blade 183.

Referring to FIG. 2, the conveyance screw 188 is disposed on the downstream side of both the cleaning blade 183 and scraper 185. It is disposed within a conveyance groove 189, which makes up the bottommost portion of the case 192. The conveyance screw 188 is disposed in parallel to the fur brush 181 and bias roller 182. It is rotatably supported by the case 192, by the lengthwise ends. The rear end portion of the conveyance groove 189 is provided with an opening, which is in connection to an unshown waste toner container. The conveyance screw 188 rotates by being driven by an unshown motor. As it is rotated, it rearwardly conveys the adherent contaminants such as the waste toner having fallen into the conveyance groove 189, and discharges the contaminants into the waste toner container.

Referring to FIG. 2, the space which is under the secondary transfer belt 176, and in which the cleaning device 18 is disposed, and the space which is on the top side of the secondary transfer belt 176, and through which a sheet P of recording medium is conveyed, are partitioned from each other by a sealing member 192*a*, which extends inward of the case 192 from the inward surface of the case 192. More specifically, in terms of the conveyance direction of the secondary transfer belt 176, this sealing member 192 is disposed on the upstream side of the secondary transferring portion T2, and is extended from the inward surface of the case 192 toward the secondary transfer belt 176, so that the tip of the sealing member 192*a* is positioned close to the secondary transfer belt 176, with the provision of a gap preset to be small enough to enable the sealing member 192*a* to prevent the toner particles and the like from scattering.

By the way, in this embodiment, the fur brush 181 is disposed on the bottom side of the secondary transfer belt 176. In terms of the left-right direction, it is disposed in the adjacencies of the center of the secondary transfer belt 176. However, it may be positioned so that it opposes the driver roller 171 for the secondary transfer belt 176, for example (FIG. 2). In such a case, it is desired that the center portion of the sealing member 192*a* in terms of its lengthwise direction is cut out, so that the sealing member 192*a* will be on both sides of the portion of the fur brush 181, which is planted with brush fibers 181*b*, and also, so that as the sealing member 192*a* is seen from the direction parallel to the widthwise direction of the secondary transfer belt 176, it overlaps with the fur brush 181. With this structural arrangement, in the case of a cleaning device having two fur brushes, for example, on the upstream and downstream, one for one, the sealing member 192*a* functions as a side seal for preventing the problem that toner particles and the like contaminants pass by the lengthwise end portions of the downstream fur brush, and scatter.

[Comparative Cleaning Device]

Figure 4:
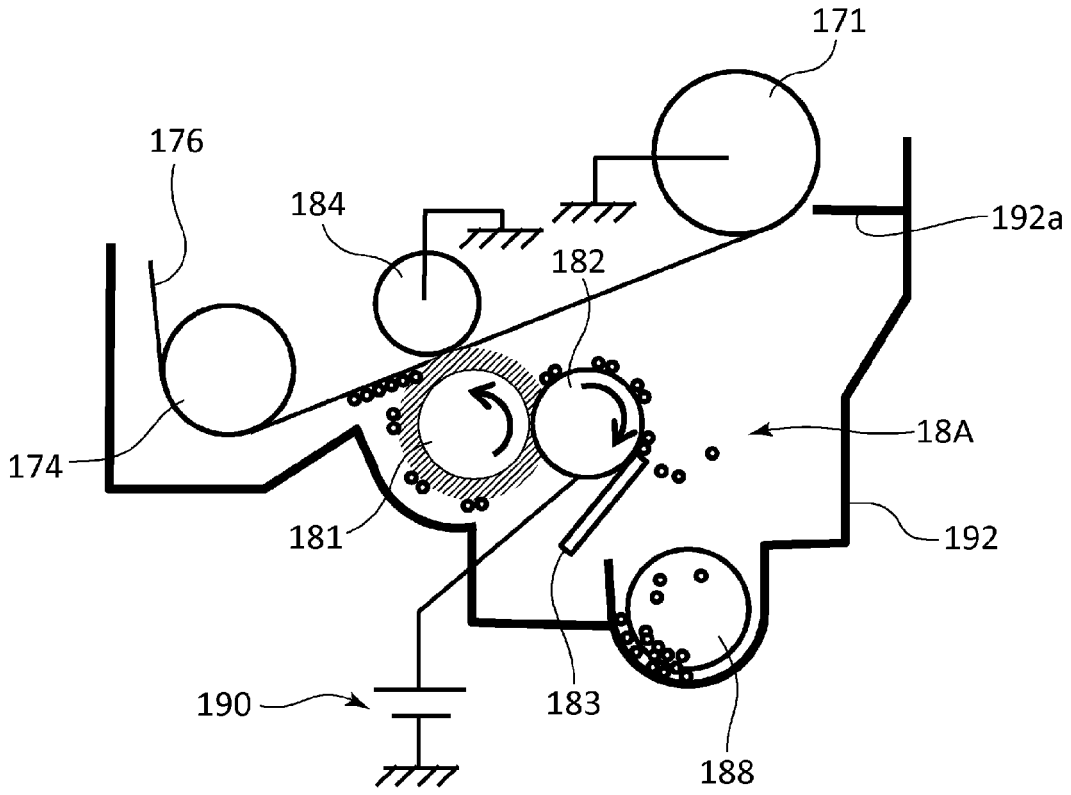
FIG. 4 is a sectional view of a comparative (conventional) cleaning device.

Next, a cleaning device 18A, which is an example of cleaning device which is comparable to the cleaning device 18 in this embodiment, and a phenomenon which will possibly occur when the cleaning device 18A is used, are described. Referring to FIG. 4, this cleaning device 18A is different from the above described cleaning device 18 only in that it is not provided with a scraper which contacts the bias roller 182. Otherwise, the cleaning device 18A is similar in structure to the cleaning device 18. Therefore, the members of the cleaning device 18A which are similar in structure to the counterparts of the cleaning device 18 are given the same referential codes as those given to the counterparts, and are not described.

Figure 5:
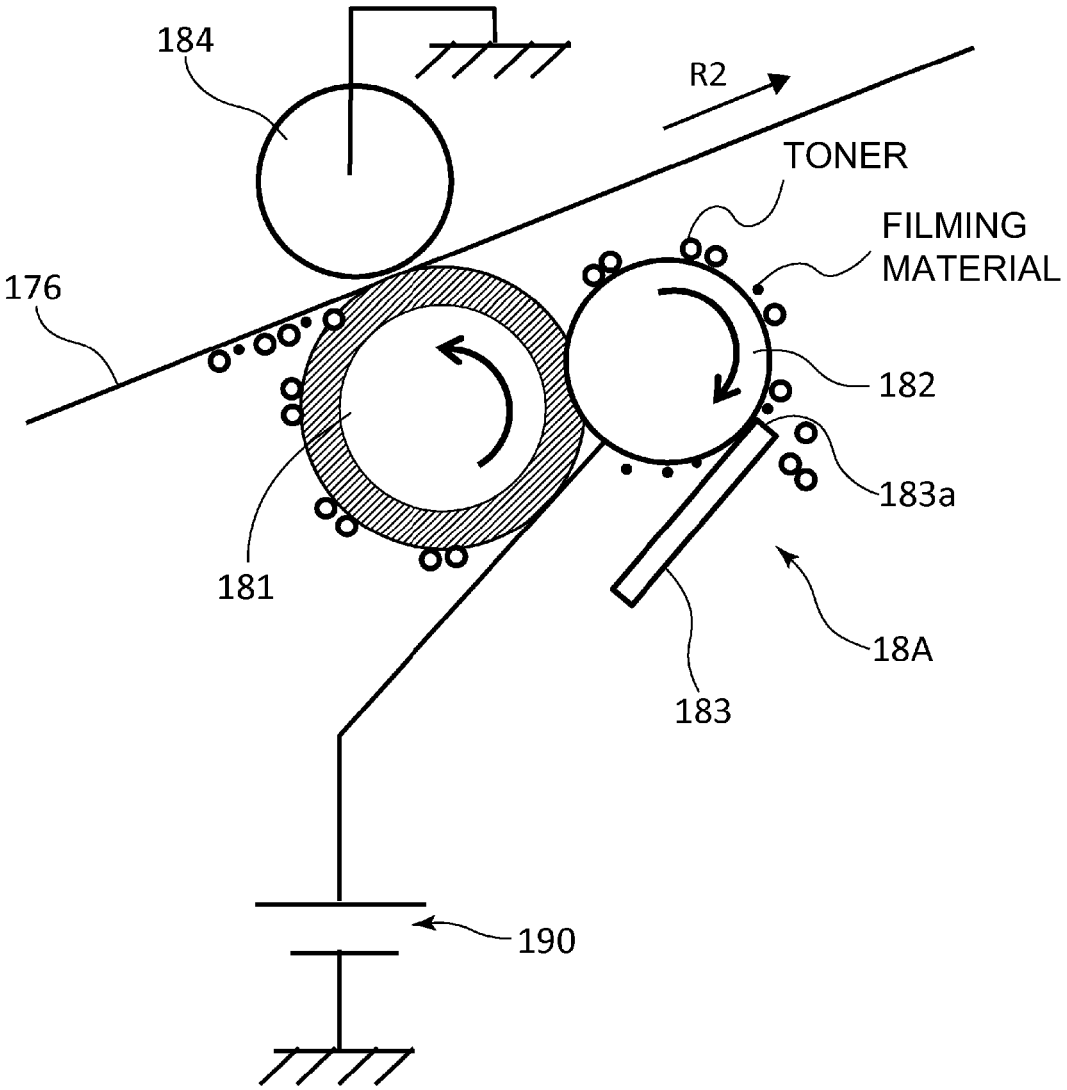
FIG. 5 is a schematic drawing of the essential portion of the comparative (conventional) cleaning device.
Figure 6:
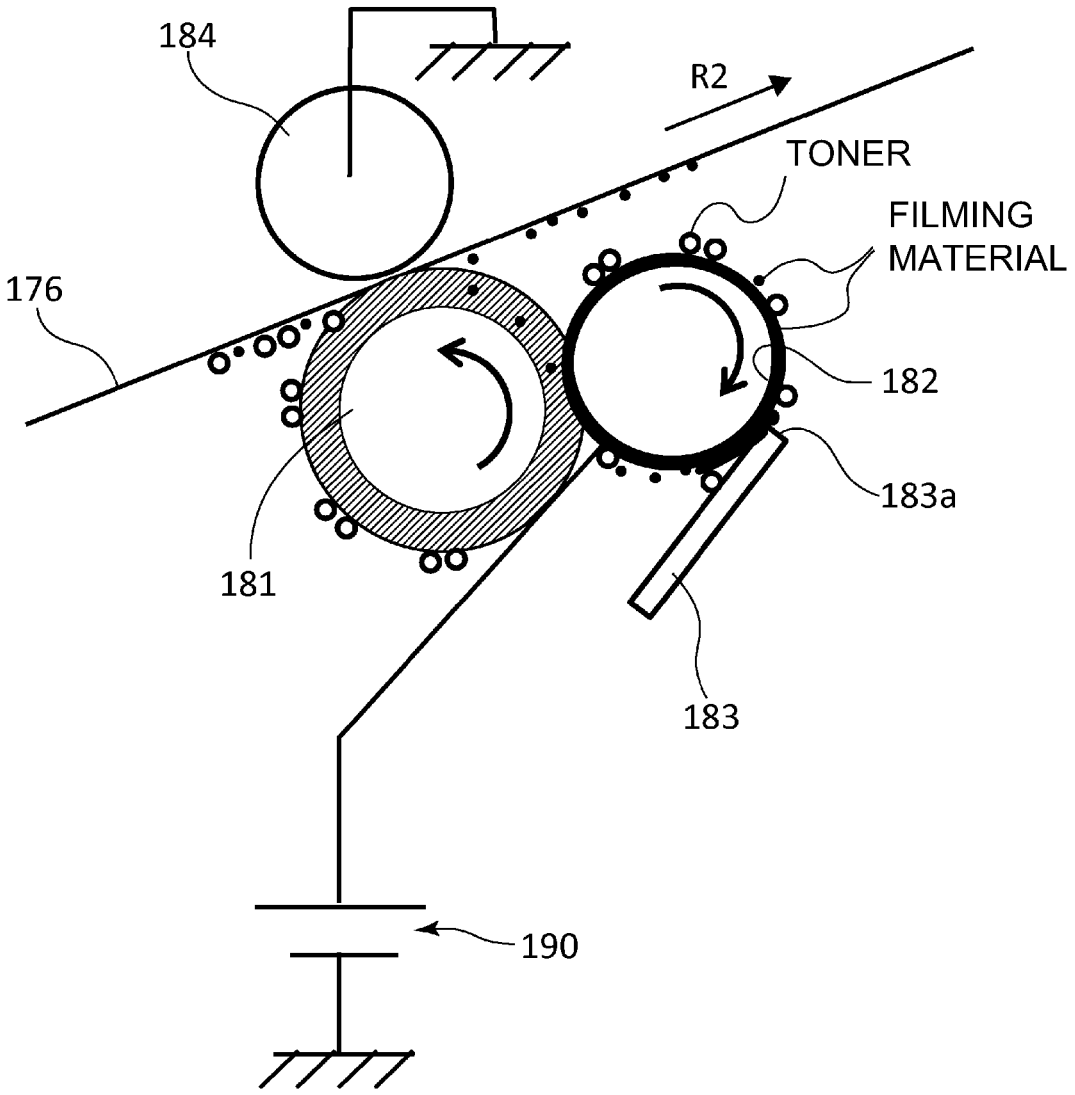
FIG. 6 is a schematic drawing of the essential portion of the comparative (conventional) cleaning device after the accumulation of the film forming substances.

Referring to FIG. 5, the cleaning device 18A has: the fur brush 181 which is in contact with the secondary transfer belt 176; the bias roller 182 which is in contact with the fur brush 181; and the cleaning blade 183 which is in contact with the bias roller 182. The toner particles having adhered to the secondary transfer belt 176 are adhered to the fur brush 181, and then, are recovered by the bias roller 182. The toner particles recovered by the bias roller 182 are scrapped down by the cleaning blade 183, and are conveyed toward the waste toner container by the conveyance screw 188.

Here, the contaminants which adhere to the surface of the secondary transfer belt 176 include film forming substances such as wax and talc, in addition to toner. "Film forming substance" is a general term for a substance which is capable of adhering to the peripheral surface of the bias roller 182 in a manner of forming a layer of film (filming) across the peripheral surface of the bias roller 182. More concretely, it is the filler for the paper used as recording medium (sheet P), external additives (talc and wax, for example) to toner, or the like. Some particles of talc and paper filler are smaller (1/20-1/3) in diameter than toner particle. Therefore, they are difficult to completely scrape away with the use of cleaning blade 183. Further, the film forming substance such as wax, which is adhesive, firmly adheres to the bias roller 182. Therefore, it is difficult to remove with the use of a cleaning blade if the contact pressure between the cleaning blade and bias roller 182 is ordinary.

A part of the film forming substance having adhered to the peripheral surface of the secondary transfer belt 176 adheres to the fur brush 181, and then, adheres to the bias roller 182.

As described above, in the case of the comparative cleaning device 18A, the film forming substance having adhered to the bias roller 182 is not entirely removed. Thus, the film forming substance gradually accumulates on the peripheral surface of the bias roller 182.

As the film forming substances on the bias roller 182 increases, the peripheral surface of the bias roller 182 is covered with a layer of film forming substance. If the bias roller 182 is continuously rotated while remaining covered with the layer of film forming substance, the film forming substance begins to granulate, creating seed granules, along the edge portion 183*a* of the cleaning blade 183. As the seed granules form along the edge portion 183*a*, the particles of the film forming substance on the bias roller 182 collide with the seed granules. Thus, the seed granules of film forming substance continue to grow along the edge portion 183*a*.

As the seed granules of film forming substance grow along the edge portion 183*a* of the cleaning blade 183, they lodge in the area of contact between the cleaning blade 183 and fur brush 181, causing thereby the cleaning blade 183 to warp. As the cleaning blade 183 warps, it becomes easier for a part of the toner adhered to the bias roller 182 to slip by the cleaning blade 183. As the toner on the bias roller 182 slips by the cleaning blade 183, it transfers onto the secondary transfer belt 176 by way of the fur brush 181, which in turn possibly causes the problem that the opposite surface of a sheet P of recording medium from the surface onto which a toner image is being transferred is soiled by the transferred toner on the secondary transfer belt 176. Further, not only toner, but also, the film forming substances fail to be removed, and accumulate on the surface of the secondary transfer belt 176, which in turn possibly causes the soiling of the back surface of the sheet P, and/or recording medium conveyance error.

[Structure of Scraper and Cleaning Blade]

Thus, this embodiment solves the above described issue by providing the cleaning device 18 with the scraper 185 capable of removing the film forming substances, in addition to the cleaning blade 183 for removing toner. Next, the scraper 185 and cleaning blade 183 are described in detail.

Figure 7:
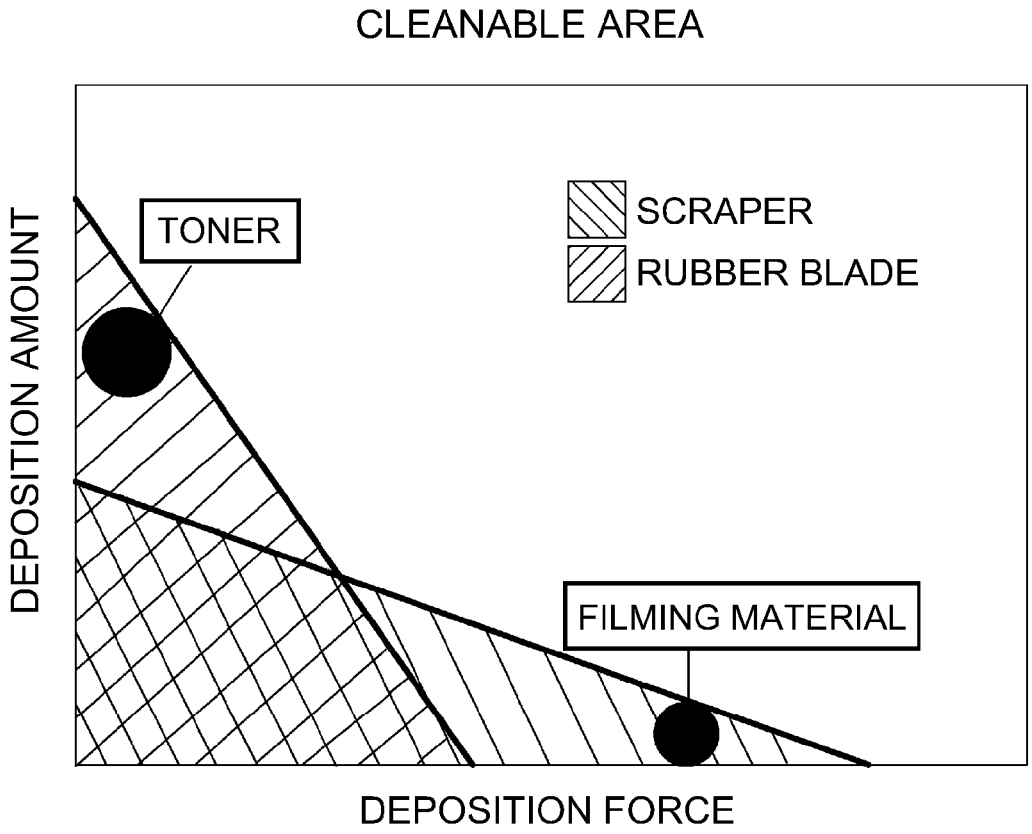
FIG. 7 is a schematic drawing for showing the difference in cleaning performance between a rubber blade and a scraper, and the difference in properties between toner and film forming substances.

To begin with, referring to FIG. 7, the difference between the properties of the rubber blade, and those of the scraper, are described. FIG. 7 is a schematic drawing for showing the range of strength of adhesion between the blade or scraper, and bias roller 182, in which the adherent contaminants can be removed by the blade or scraper, when the blade made of rubber, or scraper made of plastic, is used as the scraping member for scraping away the adherent contaminants having adhered to an object to be cleaned.

A rubber blade can scrape away by a large amount adherent contaminants such as toner which is relatively small in adhesiveness. However, when it is used to scrape away adherents which are relatively great in adhesiveness, its performance is substantially smaller. This phenomenon occurs for the following reason. That is, a rubber blade is small in coefficient of elasticity. Therefore, the area of contact between a rubber blade and an object to be cleaned is relatively large. Thus, even if a large amount of adherent contaminants is on the object to be cleaned, it is difficult for the adherent contaminants to slip by a rubber blade. On the other hand, a rubber blade is relatively small in the maximum value of the contact pressure (peak pressure in area of contact) between itself and an object to be cleaned. Therefore, a rubber blade is less effective to remove adherent contaminants such as film forming substance which are relatively great in adhesiveness.

In comparison, a scraper cannot remove a large amount of adherent contaminant such as toner, but, can remove adherent contaminants such as film forming substances which are strong in adhesiveness, for the following reason. That is, a scraper is greater in coefficient of elasticity than a rubber blade, and therefore, the area of contact between a scraper and an object to be cleaned is relatively small. Therefore, the area of contact between a scraper and an object to be cleaned is higher in peak pressure than the area of contact between a rubber blade and an object to be cleaned. On the other hand, a scraper is smaller in the area of contact between itself and an object to be cleaned than a rubber blade. Therefore, it allows adherent contaminants to pass through minute gaps which occur between itself and an object to be cleaned, due to the vibrations, or the like, of its edge portions. Thus, it is not suitable to remove a large amount of adherent contaminants.

In this embodiment, therefore, the scraper 185 is made of such material that is greater in coefficient of elasticity (higher in rigidity) than the material for the cleaning blade 183, in consideration of the above described properties. The material, angle, contact pressure, etc., for this scraper 185 are determined so that the peak pressure in the area of contact between itself and bias roller 182 becomes greater than the peak pressure in the area of contact between the cleaning blade 183 and bias roller 182. By the way, "peak pressure" means the maximum value of the pressure in the area of contact between the bias roller 182 and scraper 185 or cleaning blade 183, in terms of the pressure distribution in the circumferential direction of the bias roller 182.

The material for the scraper 185 is an elastic substance which is greater in Young's modulus, which is one of coefficients of elasticity, than the material for the cleaning blade 183. As such material, it is possible to use a sheet of resin, the Young's modulus of which is in a range of 1.5-7.5 Gs. On the other hand, as the material for the cleaning blade 183, a rubbery substance such as urethane rubber can be used. In other words, it is possible to choose elastomer as the material for the cleaning blade 183, and plastic as the material for the scraper 185. By the way, the material for the scraper 185 may be chosen by using coefficient of elasticity other than Young's modulus as index (coefficient of elasticity in bending, for example). Further, all that is required of the material for the scraper 185 is that the material is greater in coefficient of elasticity than the material for the cleaning blade 183. For example, it may be a thin plate of metal.

Referring to FIG. 3, the angle $\alpha$ (inclination) of the scraper 185 relative to the peripheral surface of the bias roller 182 is set to be larger than the angle $\beta$ of the cleaning blade 183 relative to the peripheral surface of the bias roller 182. By the way, the angle $\alpha$ is the angle of the scraper 185 relative to the line which is tangential to the peripheral surface of the bias roller 182 at the point of contact between the scraper 185 and bias roller 182. As for the angle $\beta$, it is the angle of cleaning blade 183 relative to a straight line which is tangential to the peripheral surface of the bias roller 182 at the point of contact between the scraper 185 and the peripheral surface of the bias roller 182. As will be described later, it is desired that the angle $\alpha$ of the scraper 185 is set to be in a preset range.

Further, the scraper 185 and cleaning blade 183 are supported and positioned by unshown supporting members so that the values set for the amount of their fictitious intrusion into the bias roller 182 provides the total amount of pressure between them and bias roller 182. By the way, "total pressure" is an integration of contact pressure between the bias roller 182 and scraper 185 or cleaning blade 183 across the area of contact between the bias roller 182 and the edges 183*a* or 185*a*. As for "amount of fictitious intrusion", it is the length by which the edge portions 183*a* and 185*a* are made to bend in the outward direction of the bias roller 182 by being pressed upon the peripheral surface of the bias roller 182.

That is, compared to the cleaning blade 183, the scraper 185 is made of such material that is harder (greater in coefficient of elasticity) than the material for the cleaning blade 183. Further, the scraper 185 is disposed so that its angle relative to the peripheral surface of the bias roller 182 is greater than the cleaning blade 183. Therefore, the area of contact between the scraper 185 and bias roller 182 is relatively small, and therefore, is relatively high in peak pressure, whereas the area of contact between the cleaning blade 183 and bias roller 182 is relatively large, and therefore, is relatively small in peak pressure.

In this embodiment, a sheet of PET (polyethylene terephthalate (4.5 GPa, in Young's modulus)), which is 500 μm in thickness, was used as the material for the scraper 185. As the cleaning blade 183, a blade molded of urethane rubber which is 8 MPa in Young's modulus, was employed. Further, in consideration of the results of the studies which will be described later, the angle of the scraper 185 was set to 47°, and the amount of fictitious intrusion of the scraper 185 into the bias roller 182 was set to 2.1 mm. If the value of the total amount of this pressure is converted into contact pressure between the scraper 185 and bias roller 182 per 10 mm in terms of the lengthwise direction, it is roughly in a range of 0.44 N-1.17 N. As for the angle β of the cleaning blade 183 relative to the bias roller 182, it is 20° (β=20°). The amount of its fictitious intrusion into the bias roller 182 is set to 1 mm so that the total pressure is 10 N (1000 gf). However, this total pressure is equivalent to roughly 0.30 N in the contact pressure between the cleaning blade 183 and bias roller 182 per 10 mm in terms of the lengthwise direction of the edge portion 183*a* of the cleaning blade 183.

[Examination of Condition of Contact Between Scraper and Bias Roller]

Figure 8:
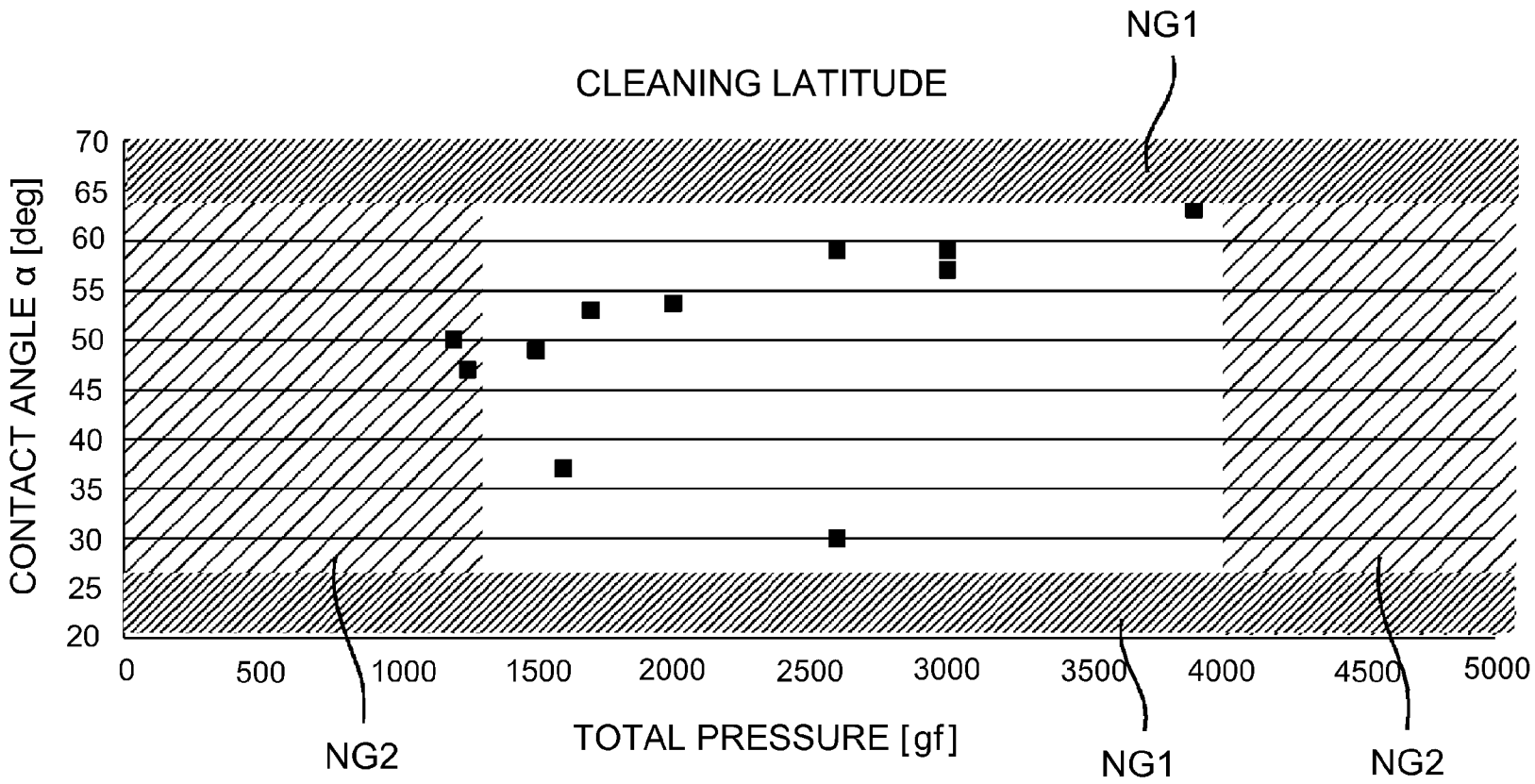
FIG. 8 is a drawing for showing the results of the studies made to find the relationship between the contact pressure of a scraper, and the angle of the scraper.
Figure 9:
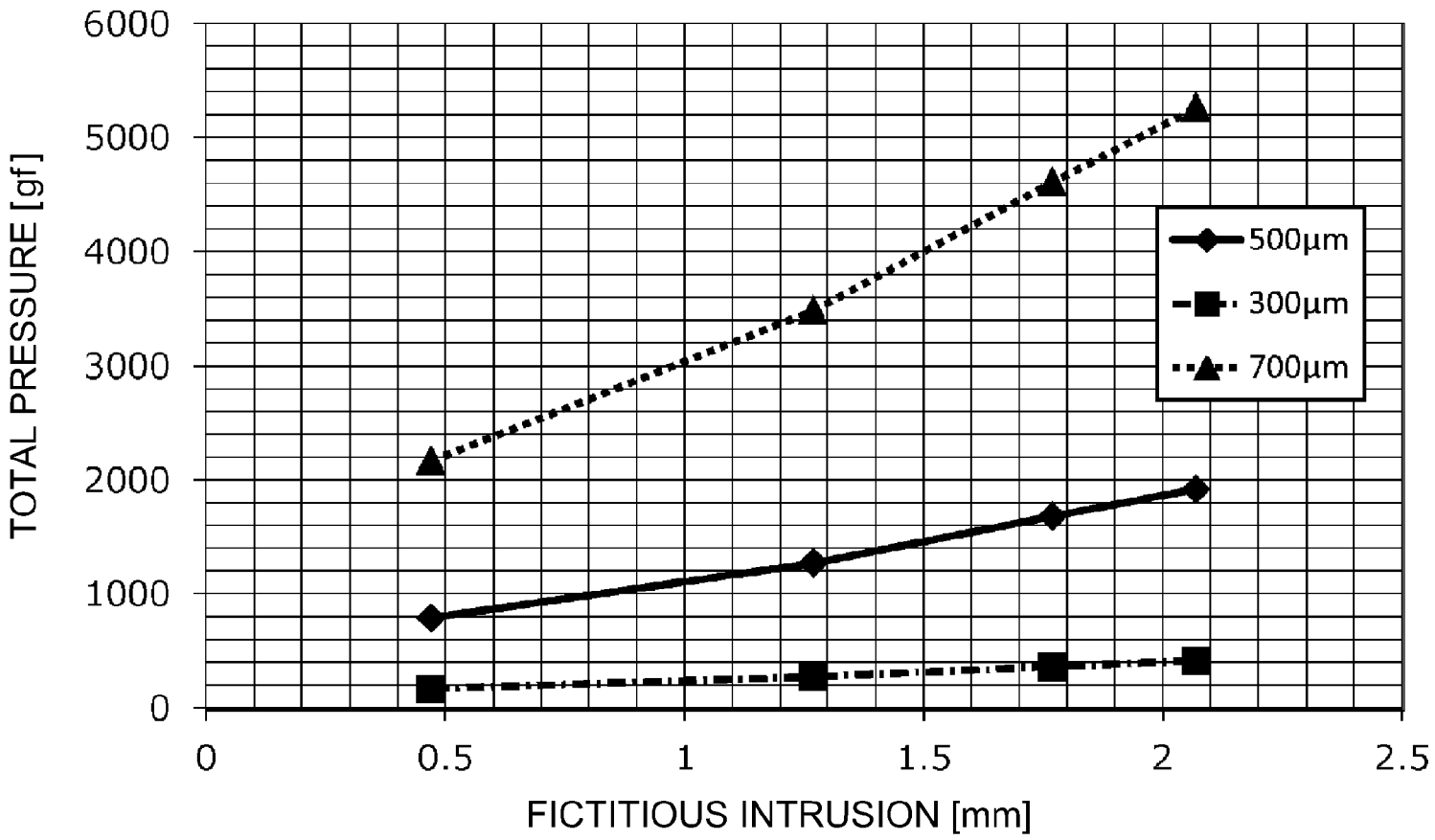
FIG. 9 is a graph which shows the relationship between the thickness of a scraper, and the amount of the fictitious intrusion of the scraper.

Next, referring to FIGS. 8 and 9, the results of the examination of the angle set for scraper 185 relative to the peripheral surface of the bias roller 182, and the contact pressure set for the scraper 185 relative to the peripheral surface of the bias roller 182 when the scraper 185 is placed in contact with the bias roller 182 is described. The inventors of the present invention repeated the following tests to try to find out a range (latitude) in which the angle and contact pressure for the scraper 185 can be set. First, an image forming apparatus was prepared, the angle α of the cleaning blade 183 of which was set to a preset value, and the amount of fictitious intrusion of the cleaning blade 183 of which was set to make the total amount of contact pressure take a preset value. Then, this image forming apparatus was made to operate in two-sided mode to continuously output 8,000 prints (16,000 images) which were 100% in duty (solid image). Then, after the completion of the operation, the cleaning blade 183 and scraper 185 were examined about the presence or absence of the toner which slipped by the cleaning blade 183 and scraper 185 and collected on the surface of the bias roller 182. Typically, the presence of this type of toner on the peripheral surface of the bias roller 182 can be recognized as the presence of stripes, which extend in the circumferential direction of the bias roller 182, on the peripheral surface of the bias roller 182.

Each dot in FIG. 8, which is a scatter diagram, represents the condition (angle and total pressure) under which the cleaning blade 183 and scraper 185 were excellent in cleaning performance in the aforementioned tests. Regarding the angle α, it was confirmed when the angle α is no less than 30° and no more than 60° (except for area NG1), the cleaning device 18 was generally excellent in cleaning performance. When the angle α was greater than this range (α>60°), the edge portion 185*a* of the scraper 185 was dragged (made to buckle) downstream in terms of the rotational direction of the bias roller 182, and therefore, the scraper 185 was not stable in the state of contact between itself and bias roller 182. On the other hand, when the angle α was no more than the abovementioned range (α<30°), the area of contact became undesirably larger, and therefore, the peak pressure became smaller. Thus, the removal of the film forming substances was insufficient.

Regarding the total pressure, it was confirmed that when it was no less than 1,500 gf and no more than 4,000 g (15N-40N), (except for area NG2), the cleaning blade 183 is excellent in cleaning performance. If the total pressure was set to be no less than 4,000 gf, the scraper 185 became excessive in the amount of its fictitious intrusion into the bias roller 182. Consequently, the portion of the scraper 185, which contacted (surface-to-surface contact) the bias roller 182, was on the base side of the edge portion 185*a*. Therefore, the scraper 185 was less in performance in terms of its ability to scrape away the film forming substances. In a case where the scraper 185 was made of a sheet of abovementioned PET, the contact between the scraper 185 and bias roller 182 became a surface-to-surface contact when the amount of fictitious intrusion was set to no less than 4 mm. Further, when the total pressure was set to no more than 1,500 gf, the contact pressure also reduced, and therefore, the peak pressure also reduced. Thus, the scraper 185 reduced in performance in terms of its ability to scrape away the film forming substances. In consideration of the results of the above described examination, in this embodiment, the angle α and the amount of fictitious intrusion were set to 47° and 2.1 mm, respectively.

Next, the results of the examination of the thickness of a sheet of PET used as the scraper 185 is described. FIG. 9 shows the relationship between the total pressure and the amount of fictitious intrusion when three scrapers 185 (sheets of PET) which are different in thickness (300, 500 and 700 [μm]) were placed in contact with a rigid member such as the bias roller 182 at an angle of 47°. As will be evident from FIG. 9, regardless of the thickness of PET sheet, as the PET sheets were increased in the amount of the fictitious intrusion within a range of 0.5 mm-2.1 mm, the total pressure proportionally increased. In a case where a sheet of PET which is thinner (300 μm) than the scraper 185 in this embodiment is used as a scraper, as the amount of intrusion exceeded 1.8 mm, the total pressure exceeded 4,000 gf. Therefore, it is desired that the amount of intrusion is set according to the thickness of a sheet to be used for the material for the scraper 185, so that the contact pressure falls within the above described range (no less than 0.44 N and no more than 1.17 N per 10 mm of edge portion 185*a* in terms of lengthwise direction).

[Positional Relationship Among Cleaning Members of Cleaning Device]

Figure 10:
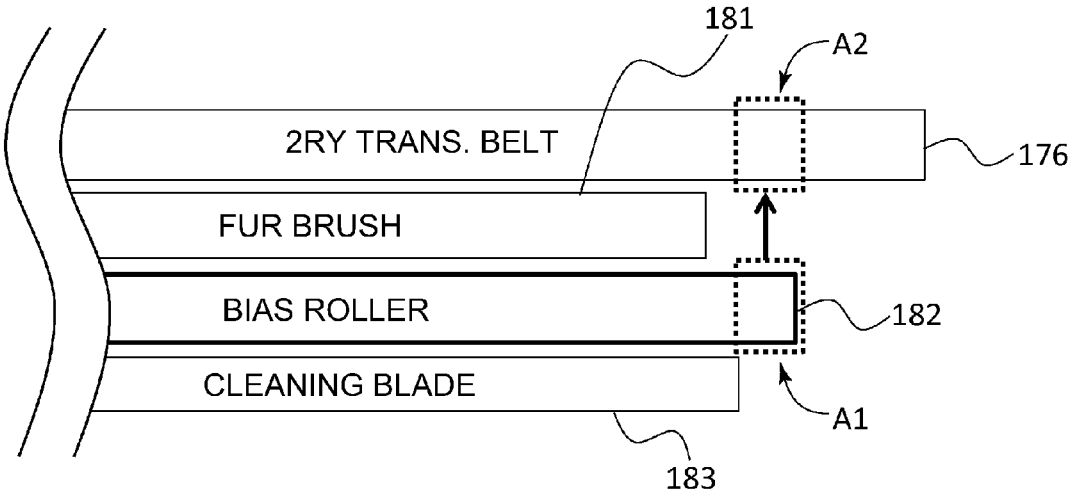
FIG. 10 is a drawing for showing positional relationship among various members of the comparative (conventional) cleaning device in terms of their lengthwise direction.
Figure 11:
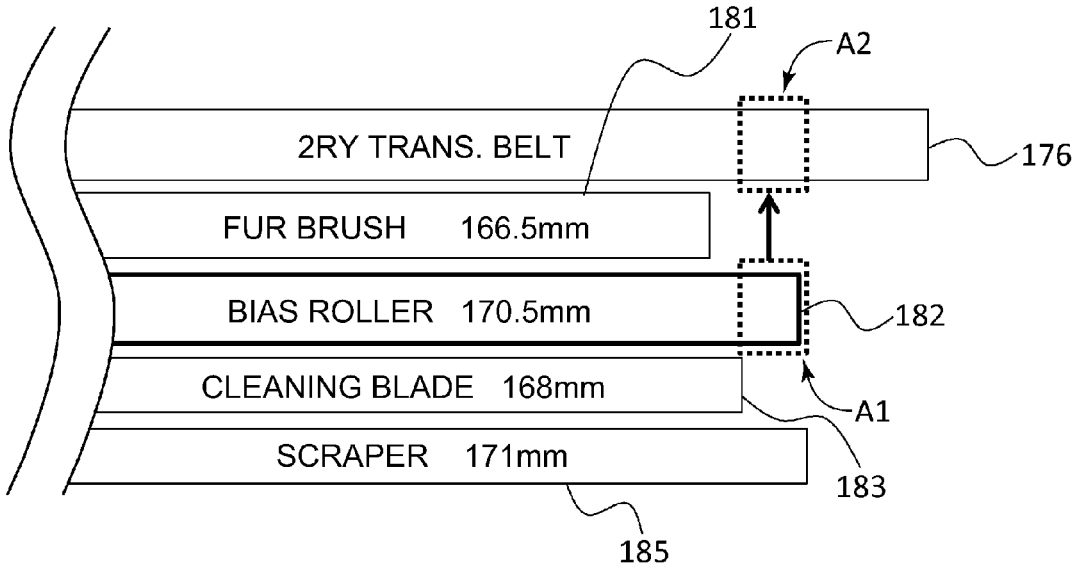
FIG. 11 is a schematic drawing for showing the positional relationship among various members of the cleaning device in accordance with the present invention, in terms of their lengthwise direction.

Next, referring to FIGS. 10 and 11, the positional relationship among the cleaning members of the cleaning device 18 in terms of the widthwise direction (lengthwise direction) are described. As described above, the fur brush 181, bias roller 182, cleaning blade 183, and scraper 185 are disposed so that they become parallel to each other, and also, so that in terms of their lengthwise direction, their centers coincide. FIGS. 10 and 11 show the positional relationship among these members regarding one of their lengthwise ends, when their lengthwise centers coincide. By the way, their positional relationship on the opposite lengthwise end of the cleaning device 18 is the same as the one shown in FIGS. 10 and 11.

Referring to FIG. 10, in the case of the comparative cleaning device 18A, the cleaning blade 183 was made longer than the fur brush 181, and the bias roller 182 was made longer than the cleaning blade 183. By the way, the "length" of the fur brush 181 means the length of the portion of the core portion 181*a* of the fur brush 181, which are planted with fibers 181*b*. Further, the width of the secondary transfer belt 176 was made greater than the length of the bias roller 182.

Further, the fur brush 181 was made longer than the development coat width of the developing device 4. By the way, the "development coat width" means the maximum width by which the development sleeve can be coated with toner. More concretely, virtually the entirety (except for lengthwise ends) of the peripheral surface of the development sleeve is provided with microscopic peaks and valleys created by blasting or the like procedure. The dimension of this area of the development sleeve in terms of the direction parallel to the rotational axis of the development sleeve is the "development coat width". Therefore, the fur brush 181 was made long enough to cover the entirety of the widest toner image which can be transferred from the photosensitive drum 1 onto the secondary transfer belt 176 by way of the intermediary transfer belt 7.

By the way, in a case where the edge portion 183*a* of the cleaning blade 183 remains in contact with the corresponding lengthwise end portion of the bias roller 182, the friction between the two portions makes the edge portion 183*a* unstable in behavior, being therefore likely to cause the following problems. That is, the friction is likely to cause the cleaning blade 183 to vibrate, buckle, and/or generate high pitch noises. Therefore, the cleaning device 18A is structured so that the cleaning blade 183 is shorter than the bias roller 182 as described above, and the edge portion 183*a* does not contact the end portion A1 (surrounded by dotted line) of the bias roller 182.

In the case of this cleaning device 18A, the cleaning blade 183 was made longer than the fur brush 181. Therefore, most of the toner recovered by the bias roller 182 from the fur brush 181 was scraped down by the cleaning blade 183. However, in a case where the image forming apparatus 100 was made to operate for a substantial length of time, it sometimes occurred that adherent contaminants, which are mainly toner particles, adhered to the lengthwise end portion A1 of the bias roller 182 in the form of a necklace (ring). One of the causes of this phenomenon is that the toner particles are made to scatter by the flicking or the like movements of the brush fibers 181*b*, which occur due to the contact between the fur brush 181 and bias roller 182, and then, are electrostatically adhered to the lengthwise end portion A1 of the bias roller 182 which is being supplied with the bias voltage. Another cause of this phenomenon is that dust floating in the case 192 is electrostatically adhered to the lengthwise end portion A1.

Since the lengthwise end portion A1 does not come into contact with the cleaning blade 183, the abovementioned contaminants (toner particles, dust particles, etc.) having adhered to the lengthwise end portion A1 in the form of a ring are not removed, and therefore, collect and gradually grow into a large body of adherent contaminant, as the image forming apparatus 100 repeatedly forms images. Eventually, the body of adherent contaminants grows large enough to correspond in position to the area A2 (surrounded by dotted line) of the secondary transfer belt 176, and contaminates the secondary transfer belt 176, possibly making defective the image on the back surface (second surface) of a sheet P of recording medium, in the secondary transferring portion T2. A certain amount of the adherent contaminants having adhered to the secondary transfer belt 176 is blocked by the sealing member 192*a*. However, as the contaminants increase, they overrun the sealing member 192*a*.

Referring to FIG. 11, in this embodiment, the scraper 185 was made longer than the bias roller 182 (recovery roller), so that the entirety of the bias roller 182 in terms of its lengthwise direction is contacted by the edge portion 185*a* of the scraper 185. Except for the size and positioning of the scraper 185 relative to the other members, the cleaning device 18 in this embodiment is the same as the above described comparative cleaning device 18A. That is, the cleaning blade 183 is longer than the fur brush 181, and the bias roller 182 is longer than the cleaning blade 183. Further, the width of the secondary transfer belt 176 is greater than the length of the bias roller 182, and the fur brush 181 is longer than the development coat width.

In this embodiment of the present invention, in order to satisfy the relationship among the above described members of the cleaning device 18 in terms of size and positioning, the abovementioned brush, roller, and blade are made so that their dimension in terms of the area from their center to one of the lengthwise ends become as shown in FIG. 11. That is, the fur brush 181 is 166.5 mm; the bias roller 182, 170.5 mm; the cleaning blade 183, 168 mm; and the scraper 185 is 171 mm. By the way, the entire length of each member is twice the above given value.

[Cleaning of Secondary Transfer Belt by Cleaning Device]

The image forming apparatus 100 structured as described above removes adherent contaminants such as toner and film forming substance having adhered to the secondary transfer belt 176, while forming an image on a sheet P of recording medium and outputting the sheet P. Next, each of the essential steps in the process for removing the toner particles, film forming substances, and the like contaminants is described with reference to a case in which a control patch is formed. By the way, a process for cleaning the secondary transfer belt 176 when a control patch is not formed is the same as the process for cleaning the secondary transfer belt 176 when a control patch is formed. A control patch which is going to make up a part of the toner which adheres to the secondary transfer belt 176 is transferred from the intermediary transfer belt 7 onto the secondary transfer belt 176, in the secondary transferring portion T2 (FIG. 2). With the rotational movement of the secondary transfer belt 176, this control patch moves onto the bottom side of the secondary transfer unit 17.

The toner particles in the control patch are adhered to the fur brush 181 which is provided with positive bias voltage, and then, are recovered by the bias roller 182 which is provided with bias voltage which is higher than the voltage applied to the fur brush 181. Then, as the bias roller 182 is rotated, the toner particles reach the area of contact between the cleaning blade 183 and bias roller 182, in which they are blocked by the edge portion 183*a* of the cleaning blade 183, and collect along the edge portion 183*a*. Eventually, they fall from the edge portion 183*a*; that is, the toner particles are scraped away from the bias roller 182, and fall.

The film forming substances such as wax having adhered to the secondary transfer belt 176 are removed at the same time as toner is removed by the cleaning blade 183. The film forming substances having adhered to the surface of the secondary transfer belt 176 adhere to the fur brush 181 because of the electrostatic force of the fur brush 181, adhesiveness of the film forming substances themselves, and the like. Some of the film forming substances having adhered to the fur brush 181 transfer onto the bias roller 182, in the area of contact between the fur brush 181 and bias roller 182, whereas the other are scraped away, along with the toner particles, by the cleaning blade 183. As for the film forming substances which passed by the cleaning blade 183, they are conveyed to the area of contact between the bias roller 182 and scraper 185. Then, they are scrapped away by the edge portion 185*a* of the scraper 185 which are set so that it is higher in peak pressure than the cleaning blade 183. Then, they fall.

By the way, to the lengthwise end portions (end portion A1 in FIG. 11) of the bias roller 182, a small amount of toner adheres due to the flicking, or the like, of the fur brush 181. This toner passes by the cleaning blade 183 along the lengthwise ends of the cleaning blade 183, and are scraped away by the scraper 185. Then, it falls. The waste which includes the toner and film forming substance which fell from the cleaning blade 183 and scraper 185 are conveyed by the conveyance screw 188, and are discharged into the waste toner container.

As described above, in the case of the image forming apparatus 100 in this embodiment, toner which is one of the adherent contaminants which adhere to the secondary transfer belt 176, is removed with the use of primarily its cleaning blade 183, whereas the film forming substance, which is another adherent contaminant which adheres to the secondary transfer belt 176, is removed with the use of primarily its scraper 185. Further, a substance which is greater in coefficient of elasticity than the material for the cleaning blade 183 is used as the material for the scraper 185 so that the scraper 185 can effectively remove the film forming substance. Further, the scraper 185 is placed in contact with the bias roller 182 which is high in rigidity. Therefore, compared to an image forming apparatus structured so that the scraper 185 is placed in contact with the secondary transfer belt 176, it is easier to increase the scraper 185 in contact pressure, and therefore, it is easier to provide the scraper 185 with a proper amount of contact pressure for the removal of the film forming substance. Therefore, it is possible to prevent the problem that the accumulation of film forming substance on the peripheral surface of the bias roller 182 reduces the cleaning device 18 in toner removal performance. That is, the image forming apparatus 100 in this embodiment can effectively remove film forming substance, and therefore, can reliably operate for a long time.

Further, the material, angle, amount of fictitious intrusion, etc., for the scraper 185, and those for the cleaning blade 183, are chosen so that the peak pressure in the area of contact between the scraper 185 and bias roller 182 becomes greater than that between the cleaning blade 183 and bias roller 182. Therefore, the cleaning device 18 can more effectively remove the film forming substance having adhered to the secondary transfer belt 176 than a conventional cleaning device (comparative cleaning device 18A).

Further, not only is the cleaning device 18 structured so that the cleaning blade 183 is shorter than the bias roller 182, but also, so that the scraper 185 contacts the bias roller 182 across the entirety of the bias roller 182 in terms of the lengthwise direction of the bias roller 182. Therefore, not only is it possible to prevent the problem that toner adheres to the end portions of the bias roller 182 in the pattern of a ring, but also, it is possible to prevent the problem without causing the cleaning blade 183 to vibrate, and/or buckle, in order to prevent the secondary transfer belt 176 from remaining contaminated.

By the way, in the preceding embodiment of the present invention, the image forming apparatus 100 was an image forming apparatus equipped with the cleaning device 18. However, the present invention is also applicable to an image forming apparatus, the cleaning means of which is for other members than the secondary transfer belt 176. For example, the present invention is also applicable to an image forming apparatus equipped with a cleaning means which is for cleaning its intermediary transfer belt, and which is similarly structured to the cleaning device 18 in the preceding embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-133806 filed on Jul. 2, 2015, which is hereby incorporated by reference herein in its entirety.

What is claimed is:

1. An image forming apparatus comprising:

an intermediary transfer member;

a toner image forming unit configured to form a toner image on said intermediary transfer member with toner including a wax;

a transfer rotatable member contactable to an outer surface of said intermediary transfer member to form a transfer portion in which a transferring electric field for transferring the toner image from said intermediary transfer member onto a recording material fed into the transfer portion is formed;

a fixing unit configured to fix the toner image on the recording material by heating the recording material together with the toner image carried thereon;

a feeding portion configured to feed the recording material after passing through said fixing unit, said feeding portion feeding the recording material such that a surface of the recording material carrying the toner image faces toward said transfer rotatable member at the transfer portion;

an executing portion configured to execute a double-sided image forming operation for forming toner images on respective sides of the recording material while passing the recording material through said feeding portion; and a cleaning unit configured to electrostatically remove the toner from said transfer rotatable member, wherein said cleaning unit includes a brush roller, a rotatable member, a first blade member and a second blade member, and said brush roller is electroconductive and contactable with said transfer rotatable member while rotating to electrostatically attract the toner from said transfer rotatable member, wherein said rotatable member is supplied with a voltage and is contacted with said brush roller at a contact position to electrostatically attract the toner from said brush roller, wherein said first blade member contacts said rotatable member at a first cleaning position to remove the toner from said rotatable member with rotation of said rotatable member, wherein said second blade member contacts said rotatable member at a second cleaning position which is downstream of the first cleaning position and upstream of the contact position with respect to a rotational moving direction of said rotatable member and scrapes the wax from said rotatable member with the rotation of said rotatable member, and wherein said first blade member is made of elastomer material, and said second blade member is made of plastic resin material.

2. An image forming apparatus according to claim 1, said second blade member is made of material having a Young's modulus higher than that of said first blade member.

3. An image forming apparatus according to claim 1, wherein said second blade member is made of elastic material having a Young's modulus of 1.5 GPa-7.5 GPa.

4. An image forming apparatus according to claim 1, wherein said second blade member includes a polyethylene terephthalate sheet.

5. An image forming apparatus according to claim 1, wherein said rotatable member includes a metal roller.

6. An image forming apparatus according to claim 1, wherein said first blade member and said second blade member counterdirectionally contact said rotatable member, wherein said second blade member contacts said rotatable member at an inclination angle relative to a tangent line of said rotatable member at the second cleaning position, and wherein the inclination angle of said second blade member is larger than an inclination angle of said first blade member relative to a tangent line of said rotatable member at the first cleaning position.

7. An image forming apparatus according to claim 6, wherein the inclination angle of said second blade member is not less than 30° and not more than 60°.

8. An image forming apparatus according to claim 1, wherein a contact pressure of said second blade member relative to said rotatable member is not less than 0.44 N and not more than 1.17 N per 10 mm of the width of said second blade member.

9. An image forming apparatus according to claim 1, wherein a length of said first blade member in an axial direction of said rotatable member is shorter than a length of said rotatable member, and wherein a length of said second blade member in the axial direction is not shorter than the length of said rotatable member, and said second blade member contacts said rotatable member throughout a total length of said rotatable member.

10. An image forming apparatus comprising:

an intermediary transfer member;

a toner image forming unit configured to form a toner image on said intermediary transfer member with toner including a wax;

a transfer rotatable member contactable to an outer surface of said intermediary transfer member to form a transfer portion in which a transferring electric field for transferring the toner image from said intermediary transfer member onto a recording material fed into the transfer portion is formed;

a fixing unit configured to fix the toner image on the recording material by heating the recording material together with the toner image carried thereon;

a feeding portion configured to feed the recording material after passing through said fixing unit, said feeding portion feeding the recording material such that a surface of the recording material carrying the toner image faces toward said transfer rotatable member at the transfer portion;

an executing portion configured to execute a double-sided image forming operation for forming toner images on respective sides of the recording material while passing the recording material through said feeding portion; and a cleaning unit configured to electrostatically remove the toner from said transfer rotatable member, wherein said cleaning unit includes a brush roller, a rotatable member, a first blade member and a second blade member, and said brush roller is electroconductive and contactable with said transfer rotatable member while rotating to electrostatically attract the toner from said transfer rotatable member, wherein said rotatable member is supplied with a voltage and is contacted with said brush roller at a contact position to electrostatically attract the toner from said brush roller, wherein said first blade member contacts said rotatable member at a first cleaning position to remove the toner from said rotatable member with rotation of said rotatable member, wherein said second blade member contacts said rotatable member at a second cleaning position which is downstream of the first cleaning position and upstream of the contact position with respect to a rotational moving direction of said rotatable member and scrapes the wax from said rotatable member with the rotation of said rotatable member, and wherein in a pressure distribution along an outer circumferential direction of said rotatable member by said first blade member and said second blade member, a maximum value of pressure between said rotatable member and said second blade member at the second cleaning position is higher than a maximum value of pressure between said rotatable member and said first blade member at the first cleaning position.

* * * * *